US005848321A

United States Patent [19]

Roh et al.

[11] Patent Number: 5,848,321

[45] Date of Patent: Dec. 8, 1998

[54] METHOD FOR AUTOMATICALLY CONTROLLING TRANSFER VOLTAGE IN PRINTER USING ELECTROPHOTOGRAPHY SYSTEM

[75] Inventors: Seuk-Pil Roh, Suwon; Hyun-Wook Bae, Seoul, both of Rep. of Korea

[73] Assignee: SamSung Electronics Co., Ltd., Suwon, Rep. of Korea

[21] Appl. No.: 770,781

[22] Filed: Dec. 20, 1996

[30] Foreign Application Priority Data

Dec. 20, 1995 [KR] Rep. of Korea ..... 1995/52602

[51] Int. Cl.[6] ..... G03G 21/00

[52] U.S. Cl. ..... 399/45; 399/66; 399/389

[58] Field of Search ..... 399/45, 66, 314, 399/389, 21; 271/265.02, 267.04; 250/548, 559.01, 559.03, 559.11, 559.15

[56] References Cited

U.S. PATENT DOCUMENTS

| | | | |
|---|---|---|---|
| 4,468,113 | 8/1984 | Motohashi et al. . | |
| 5,049,937 | 9/1991 | Takeda . | |
| 5,099,287 | 3/1992 | Sato . | |
| 5,140,375 | 8/1992 | Shindo et al. | 399/45 |
| 5,185,633 | 2/1993 | Kawai . | |
| 5,250,999 | 10/1993 | Kimura et al. | 399/39 |
| 5,329,338 | 7/1994 | Merz et al. . | |
| 5,589,923 | 12/1996 | Lee et al. | 399/78 |

FOREIGN PATENT DOCUMENTS

| | | |
|---|---|---|
| 60-142370 | 7/1985 | Japan . |
| 1-082049 | 3/1989 | Japan . |
| 2-311880 | 12/1990 | Japan . |
| 5-072911 | 3/1993 | Japan . |
| 5-303207 | 11/1993 | Japan . |
| 6-156813 | 6/1994 | Japan . |

*Primary Examiner*—Robert Beatty
*Attorney, Agent, or Firm*—Robert E. Bushnell, Esq.

[57] ABSTRACT

An electrophotography machine is disclosed that consistently produces images of optimum image density regardless of whether an ordinary sheet of paper or a transparency is used as the recording medium. A photosensor activated in response to the recording media passing a first sensor is positioned on the paper conveyance path and detects whether or not the recording media being processed is an ordinary sheet of paper or a transparency. A controller automatically applies the appropriate transfer voltage depending on whether or not the sheet of recording media is a sheet of paper or a transparency. The special design used in this invention does not require photosensors to be placed on the photosensitive drum or near any of the image forming apparatus. Thus, the device consistently produces optimum images while being easy and inexpensive to make and manufacture.

20 Claims, 3 Drawing Sheets

METHOD FOR AUTOMATICALLY CONTROLLING TRANSFER VOLTAGE IN PRINTER USING ELECTROPHOTOGRAPHY SYSTEM

CLAIM OF PRIORITY

This application makes reference to, incorporates the same herein, and claims all benefits accruing under 35 U.S.C. §119 arising from an application for Method for Automatically Controlling Transfer Voltage in Printer Using Electrophotography System earlier filed in the Korean Industrial Property Office on 20 Dec., 1995 and there duly assigned Serial No. 52602/1995.

FIELD OF THE INVENTION

The present invention relates generally to printers using an electrophotography system. More particularly, it relates to a method of automatically controlling transfer voltages according to the type of recording media fed into an image forming unit of laser beam printer.

BACKGROUND OF THE INVENTION

The notion of adjusting the transfer voltage based on the type of recording medium used is not new in the art of electrophotography. U.S. Pat. No. 5,185,633 for an Image Forming Apparatus Having Single Sensor For Detecting Mischucking of Transfer Paper and Whether Transfer Paper is Plain or Transparent Paper to Kawai discloses a photo emitter and photodetector combination used to detect whether or not the recording medium is plain paper or a transparency. Based on the type ofrecording medium detected, Kawai '633 adjusts the transfer voltage accordingly so that the optimum image density is achieved regardless of the type of the recording medium used. The positioning of the photo detector and the photo emitter used in Kawai '633 is on the transfer drum.

In U.S. Pat. No 5,099,287 for a Transferring Voltage Control Section to Sato discloses an electrophotographic machine that adjusts the transfer voltage according to the size and width of the recording medium. Thus, postcards and other materials will emerge from the machine with optimum image density. No mention is made of the use of transparencies in Sato '287.

What is therefore needed is a simplified design for an electrophotographic machine that can sense along the paper conveyance path, instead of in the transfer drum, the material by which the recording medium is made of. In other words, what is needed is a photosensor that can distinguish between a plain sheet of paper and a transparency without requiring design limitations for the image forming apparatus. Thus, what is needed is a less expensive and easier to manufacture electrophotographic machine that can detect whether or not the recording medium is a transparency or a plain sheet of paper, and adjust the transfer voltage accordingly so that optimum image density is achieved every time.

SUMMARY OF THE INVENTION

Therefore, it is an object to present an electrophotographic machine that contains a photosensor along the paper conveyance path that can detect whether or not the recording medium being conveyed is a plain sheet of paper or a transparency.

It is also an object to relay the information gathered by the photosensor on the conveyance path to the transfer voltage controller to adjust the transfer voltage according to the type of recording medium sensed by the photosensor.

In order to realize the above object, the present invention provides a method of automatically controlling transfer voltages of a printer using an electrophotography system having on a conveyance path a photo sensor for determining if the sheet of recording medium being conveyed is a transparency or a plain sheet of paper. The inventive method includes the steps of operating the photo sensor in case that a paper sensing signal is received by the central processing unit of the electrophotographic machine, and if an overhead transparency is being conveyed to the image forming unit, setting a voltage to a level that is preestablished for toner image transfer onto overhead projector (OHP) transparency in response to the signal sensed by the photosensor, and if a normal paper is being conveyed to the image forming unit, setting a voltage to a level that is preestablished for toner image transfer onto normal paper for printer performance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

A common-type laser beam printer that employs an electrostatic image forming process includes automatic paper feed and secondary manual feed options. The automatic paper feed option is used to feed A4 or B4 paper to an image forming unit of the printer, and the secondary paper feed option is employed to manually feed a piece of paper or special paper such as overhead transparencies. The special paper is formed to be thick, and it is difficult to feed it by the automatic paper feed. Particularly, overhead transparencies which are of special size and thickness have higher resistance than normal papers. Accordingly, when such overhead transparencies are used as print media to which toner images are transferred during printing process, higher voltages should be applied to them compared to those applied to the normal paper in order to produce documents of excellent print quality. The prior art printer commonly adjusts the optimum conditions of electrostatic image forming process on normal paper basis, and in case that toner images are transferred to the overhead transparency, the density of the images becomes decreased.

Reference will now be made in detail to the preferred embodiment of the present invention, examples of which are illustrated in the accompanying drawings.

Figure 1:
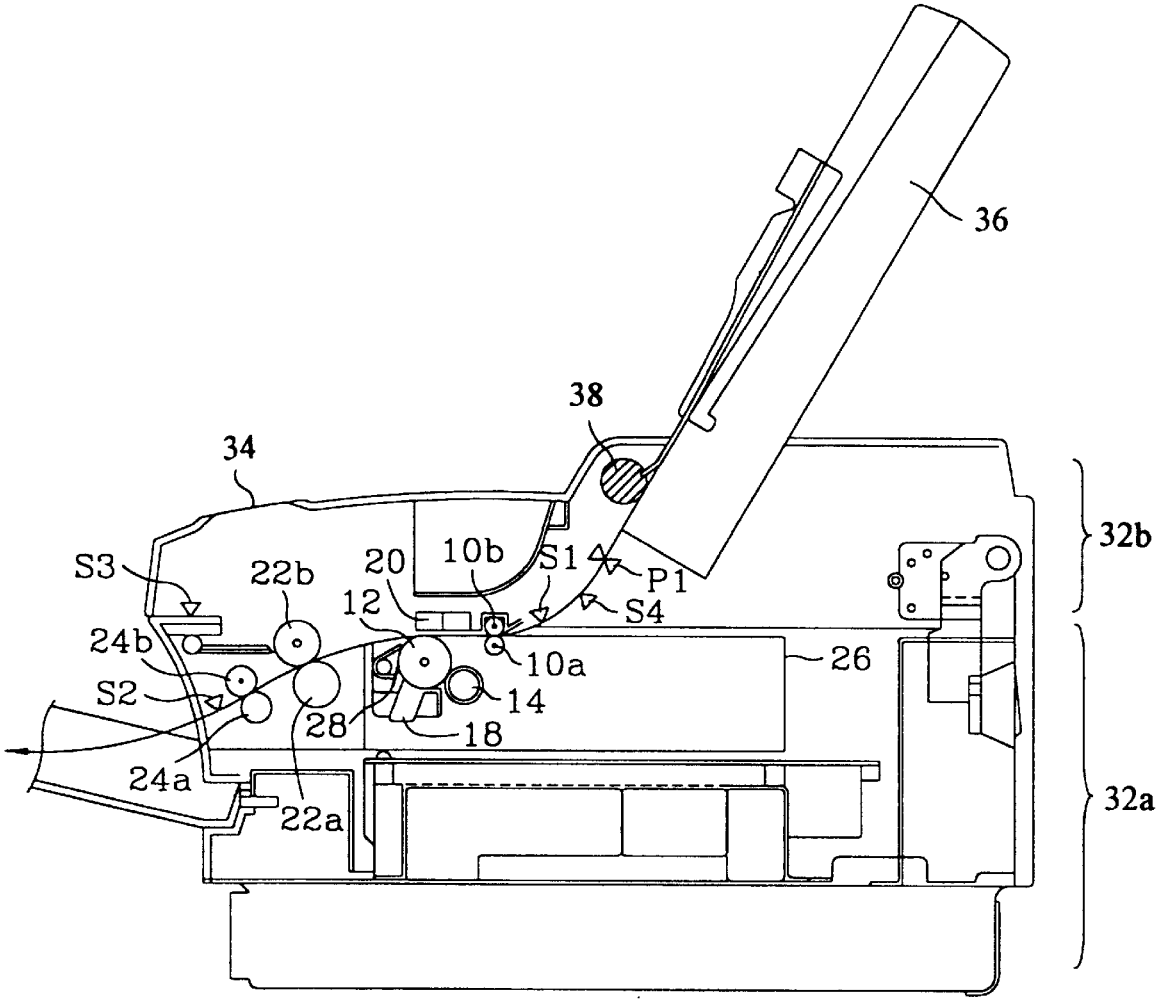
FIG. 1 depicts a schematic engine mechanism used for a laser beam printer using electrophotography, in accordance with the present invention.

FIG. 1 depicts a schematic engine mechanism employed for a laser beam printer using electrophotography, in accordance with the present invention. It additionally includes a recording media sensor P1 which is used to distinguish normal paper from overhead transparencies in order to realize present invention. A photocoupler may be used as the recording media sensor P1, and it may be positioned on a paper path between an image-forming unit, and a paper feeding unit (e.g. a paper feeder or a manual paper feeder).

Referring to FIG. 1, the laser beam printer includes a printer housing 34 which is divided into upper and lower halves 32*b* and 32*a*. The upper half 32*b* can be pivoted about a rear end hinge shaft upward with respect to the lower half 32*a*. A charger (not shown) uniformly charges an outer surface of a photoconductive drum 12.

A laser scanner unit 18 generates a pixel laser beam corresponding to a time-serial electrical pixel signal of image data, and then scans a surface of the photoconductive drum 12 with the laser beam through the mirror and an exposure window so that a latent image corresponding to the image data is formed on the photoconductive drum 12.

The charged image areas attract and hold toner supplied by a developing unit 14 to thereby form a toner image and a pickup roller 38 picks up a sheet of paper (normal paper or overhead transparencies) stacked in a paper cassette 36, and conveys it to registration rollers 10*a* and 10*b*. The registration rollers, 10*a* and 10*b* align the paper conveyed by the pickup roller 38. The toner image that has been formed on the photoconductive drum 12 is transferred to the recording medium by a transfer charger 20.

After toner image transfer, a cleaner 28 removes a residual toner on the surface of the photoconductive drum 12. Fixing units 22*a* and 22*b* allow the toner image transferred to the paper to be fixed there by heat. The fixing units 22*a* and 22*b* include a paper fixing roller 22*a* and a heating roller 22*b*, and the heating roller 22*b* is heated by a heater lamp formed inside to fuse the toner image to the paper.

Paper delivery rollers 24*a* and 24*b* deliver the image-formed paper (print) to the outside, such a printer commonly has sensors that serve to monitor the state of paper conveyance, the opening or closing of the upper half 32*b*, and the current state of paper feeding. FIG. 1 shows that first to fourth sensors S1 to S4 are mounted to fulfill the above functions.

The first sensor S1 disposed on a paper path between the pickup roller 38 and registration rollers 10*a* and 10*b*, senses the state of paper conveyed from the paper cassette 36 to the registration rollers 10*a* and 10*b*. The second sensor S2 is positioned on a paper discharge path at the rear end of the paper delivery rollers 24*a* and 24*b*, and finds out whether or not there is a fault in the delivery of paper. The third sensors S3 are respectively mounted on one side of the upper half 32*b* and one side of the lower half 32*a*, and they are oppositely disposed respective to each other. The third sensors S3 detect whether there is a fault in the opening or closing of the upper half 32*b*.

The fourth sensor S4 is positioned on the paper path between the first sensor S1 and the pickup roller 38, and detects if there is a sheet of paper that is conveyed from the paper cassette 36. The inventive photocoupler P1 is mounted on the paper path between the fourth sensor S4 and the pickup roller 38 and is actuated according to the kind of paper being conveyed to the image-forming unit.

Figure 2:
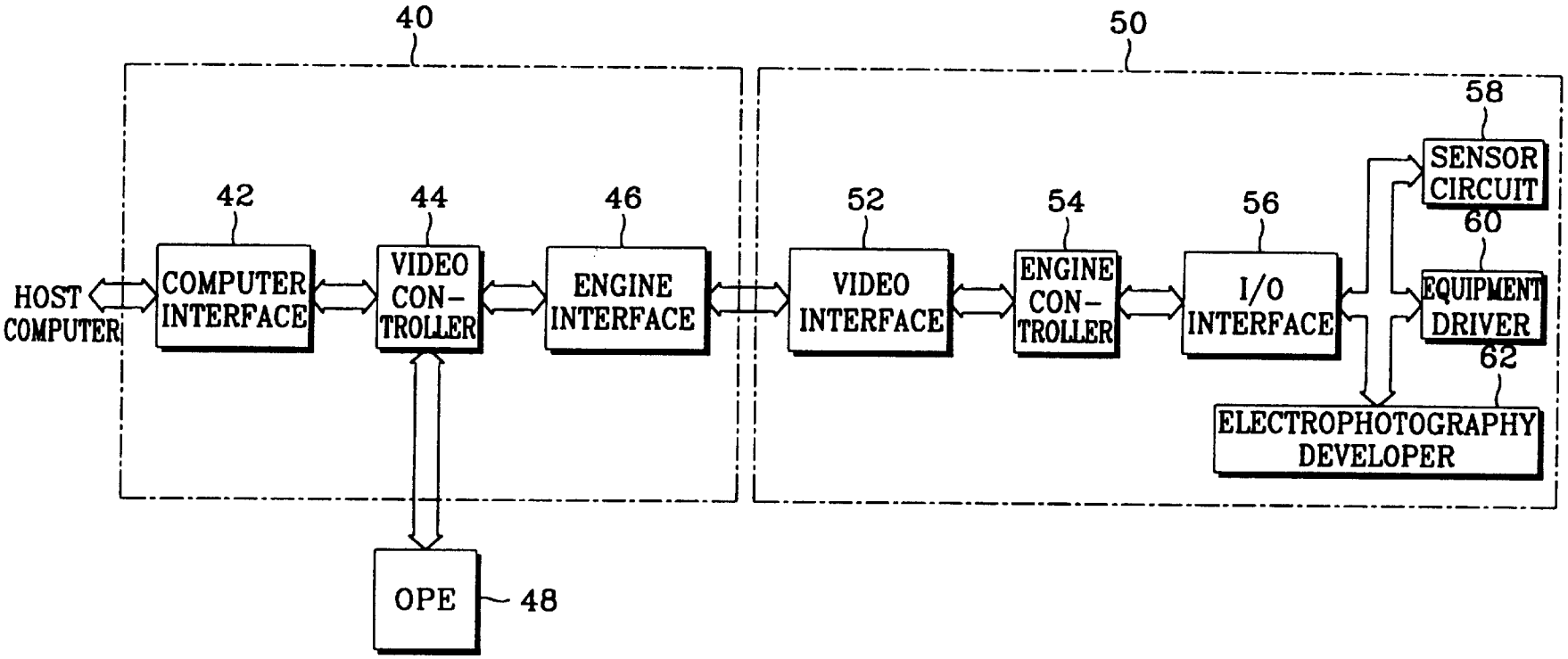
FIG. 2 is a block diagram of a laser beam printer using electrophotography in accordance with the present invention.

FIG. 2 is a block diagram of a laser beam printer using electrophotography in accordance to the present invention. The laser beam printer includes a video controlling 40, a printer engine unit 50 and an operation panel OPE 48. The video controlling unit 40 includes a computer interface 42, a video central processing unit 44, also referred to as a video controller 44 and an engine interface 46 which serve to interface input/output signals with a host computer respectively. The video controlling unit 40 converts input data from the computer interface 42 to corresponding image data so that it can be processed by the printer engine unit 50 according to a predetermined program, and then sends the converted image data into the printer engine unit 50.

The video CPU 44 has a random access memory (RAM) that temporarily stores various data produced by the host computer and the OPE 48, and a read only memory (ROM) which stores a control program in accordance with the present invention. The engine interface 46 that is connected between the video CPU 44 and the printer engine unit 50 interfaces input/output (I/O) signals with the printer engine unit 50 under the control of the video CPU 44. The OPE 48 equipped with a set of keys and a display is connected with the video CPU 44 applies data that is fed by the set of keys to the video CPU 44, and displays the information output during the printing operation.

The printer engine unit 50 includes a video interface 52, an engine central processing unit (CPU) 54, also referred to as an engine controller 54, an input/output I/O) interface 56, a sensor circuit 58, a facility driver 60, also referred to as an equipment driver 60, and an electrophotography developer 62, also referred to as the developing unit 62, and is connected to the video controlling unit 40. The video interface 52 links the video controlling unit 40 with the engine CPU 54. The engine CPU 54 has control over the facility driver 60 and the electrophotography developer 62 under the control of the video CPU 44, and prints out an image corresponding to the image data output by the video CPU 44.

The engine CPU 54 finds out whether or not there is a fault in the operation of the printer engine unit 50, and monitors whether or not paper is being conveyed to the image-forming unit, and whether or not recording media is correctly being identified as either a transparency or a piece of paper. The I/O interface 56 is connected between the engine CPU 54 and the the sensor circuit 58, the facility driver 60 and the developing unit 62 in order to link the engine 54 with the sensor circuit 58, the facility driver 60 and the developing unit 62. The sensor circuit 58 enables the sensors S1 to S4 and P1 to function properly, and supplies the engine CPU 54 with output signals produced by these sensors. The facility driver 60 allows the actuation of various operating sections of the laser beam printer used for paper feeding, paper conveyance, and printing operations. The developing unit 62 is controlled by the engine CPU 54, and actuated to record on a recording media pictorial images, corresponding to the image information, using electrophotography.

Figure 3:
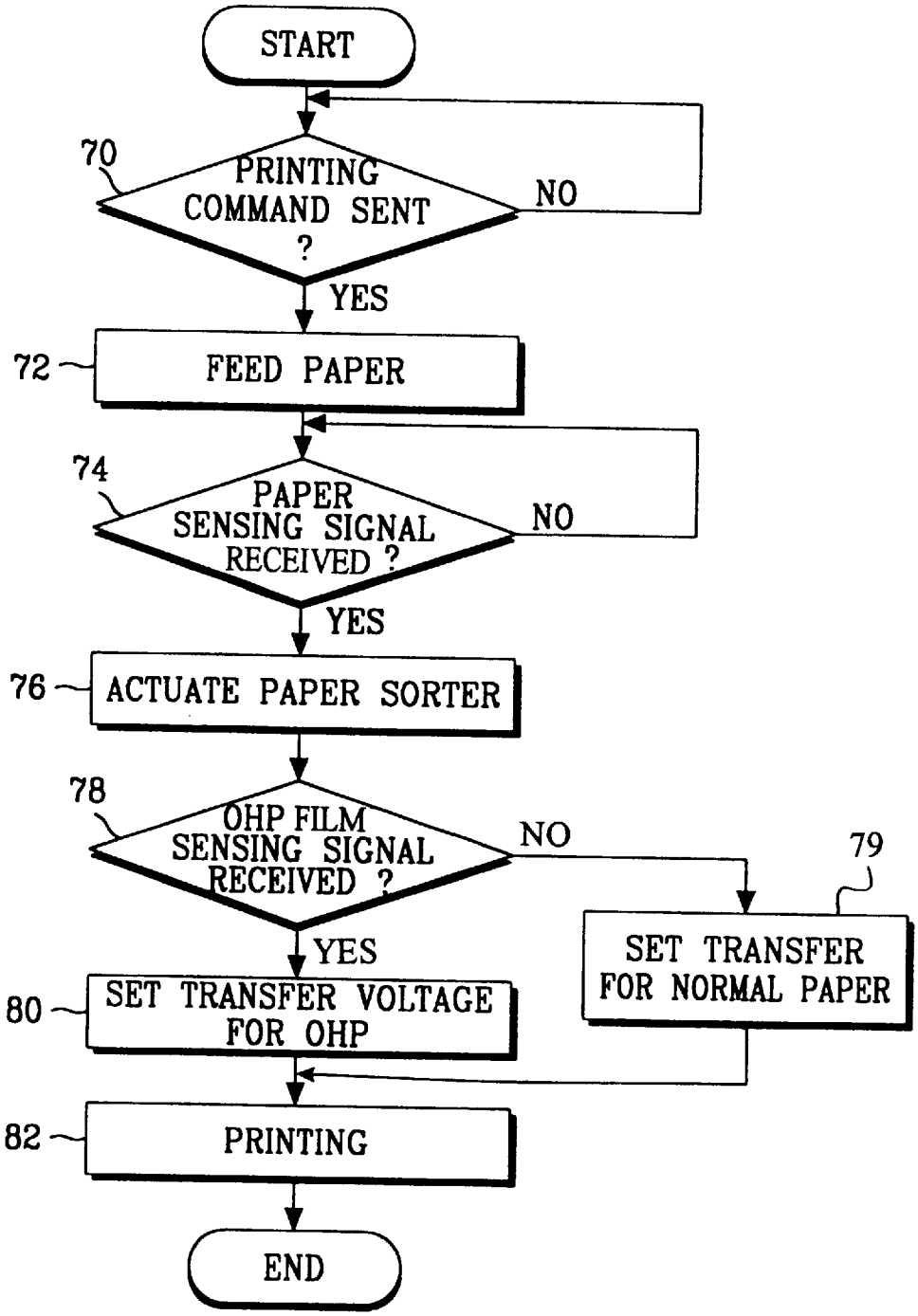
FIG. 3 shows the steps for managing an engine controller so as to automatically control voltages applied for toner image transfer in accordance with the present invention.

FIG. 3 shows the steps of controlling the engine controller 54 so as to automatically control voltages applied for toner image transfer, in accordance with the present invention. The following description relates to the management of the engine CPU 54 which operates to automatically control voltages used to transfer a toner image to an overhead transparency, with reference to FIGS. 1 to 3. While the laser beam printer using electrophotography is in standby mode, the engine CPU 54 determines in step 70 if a command to print is sent from the video CPU 44. In case that the engine CPU 54 determines that the command to print is sent therefrom, it controls in step 72 the facility driver 60 to feed paper in response to the input command and proceeds to step 74. The engine CPU 54 detects in step 74 if there is a paper sensing signal received from the fourth sensor S4. In case that the engine CPU 54 determines that the paper sensing signal is received from the fourth sensor S4, it allows in step 76 the photocoupler P1's light emitting diode to be actuated, and proceeds to step 78.

The engine CPU 54 determines in step 78 if a light-receiving transistor of the photocoupler P1 is turned on. In case that the engine CPU 54 determines that the light-receiving transistor is turned on, engine CPU 54 proceeds to step 80, and in case that the light-receiving transistor is turned off, engine CPU 54 proceeds to step 82 via step 79.

The turned-on state of the photocoupler P1, the light-receiving transistor's photocoupler P1 is indicative of the use of an overhead projector transparency as a print medium, i.e. the reception of OHP transparency sensing signal. The engine CPU 54 converts, in step 80, a voltage used for toner image transfer to a level that is preset for OHP transparency so that the transfer charger 54 can be supplied with the preset voltage for transferring a toner image to the OHP transparency, and proceeds to step 82 for printing.

When photocoupler P1 remains in the turned-off state, the engine CPU proceeds to step 79. Engine CPU 54 converts a voltage used for toner image transfer to a level that is preset for normal paper so that the transfer charger 54 is supplied with the preset voltage for normal paper, and proceeds to step 82 for printing. The engine CPU 54 has control over the facility driver 60 and the developing unit 62 to perform the printing operation, and completes the process of automatically controlling voltages used for transferring toner images to paper.

On sensing that an OHP transparency is conveyed to the image forming unit of the laser beam printer, the present invention automatically controls a voltage that is preset to a higher level for toner image transfer onto OHP transparency to be applied to the transfer charger 20 thereby producing documents of excellent print quality.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An electrophotographic device for printing images on recording media of various types, comprising:

a photosensitive drum;

a developing unit to deliver toner to said photosensitive drum;

a charging unit to uniformly charge said photosensitive drum;

an exposing unit to expose said photosensitive drum;

a transfer charger to transfer toner from said photosensitive drum to said recording media;

a fixing unit for bonding said toner onto said recording media;

a feed tray to feed said recording media into said electrophotographic device;

a first sensing unit that senses the passage of said recording media;

a second sensing unit that detects whether or not said recording media is paper or is a transparency in response to said first sensing, unit detecting the passage of said recording media, wherein a voltage bias is applied between said photosensitive drum and said transfer charger, said recording media is conveyed so as to pass between said transfer charger and said photosensitive drum, and said voltage bias being dependent on whether said second sensing unit senses whether said recording media is paper or is a transparency.

2. The electrophotographic device of claim 1, wherein said second sensing unit comprises a photoemitter and a photoreceptor.

3. The electrophotographic device of claim 2, wherein said photoreceptor is in an off state when said recording media is made of paper and said photoreceptor is in an on state when said recording media is a transparency.

4. The electrophotographic device of claim 3, wherein said electrophotographic device is connected to a host computer.

5. The electrophotographic device of claim 4, wherein said electrophotographic device prints images displayed on a video display monitor attached to said host computer.

6. A method of photocopying onto recording media of varying materials, comprisin:

feeding said recording media from a feeding tray;

conveying said recording media through a first sensing unit that activates a second sensing unit to be operational;

conveying said recording media through said second sensing unit that detects whether said recording media is made of paper or is a transparency;

conveying said recording media through an image forming unit by having said recording media proceed between an electrically charged photosensitive drum containing a toner image and a transfer charger, wherein a potential difference between said photosensitive drum and said transfer charger depends on whether said second sensing unit detects said recording media as a transparency or as a sheet of paper;

bonding said toner image to said recording media; and discharging said recordingmedia containing said image from said image forming unit.

7. The method of claim 6, wherein said second sensing unit is comprised of a photoemitter and a photodetector.

8. An electrophotographic device for printing images, comprising:

a photosensitive drum;

a charging unit to uniformly charge said photosensitive drum;

an exposing unit to expose said photosensitive drum and to produce a latent image on said photosensitive drum;

a developing unit to deliver toner to said photosensitive drum forming a toner image on said photosensitive drum over said latent image;

a transfer charger to transfer said toner image from said photosensitive drum to a sheet of recording medium;

a fixing unit for fixing said toner image to said recording medium;

an automatic feed tray to allow automatic feeding of individual sheets of recording medium into said electrophotographic device;

a recording medium conveyance path located between said automatic feed tray and said photosensitive drum for transporting sheets of recording medium from said automatic feed tray to said photosensitive drum;

a first sensing unit located on said conveyance path to determine the location of said sheet of recording medium;

a second sensing unit located on said conveyance path, activated in response to said sheet of recording medium passing said first sensing unit, to detect whether said recording medium is made of paper or is a transparency, said sensing unit generating a first signal if said sheet of recording medium is a transparency;

a transfer voltage generator for applying one of a first and second voltages to said transfer charger;

a video controller for generating a print command; and an engine control unit for generating, in response to said print command, a first control signal when said first signal is not received from said sensing unit, and for generating, in response to said print command, a second control signal when said first signal is received from said sensing unit, said voltage transfer generator applying said first voltage to said transfer charger to transfer said toner image onto said recording medium in response to reception of said first control signal, said voltage transfer generator applying said second voltage to said transfer charger in response to reception of said second control signal.

9. The electrophotographic device of claim 8, said second sensing unit being a photo emitter and a photosensor.

10. A method of photocopying on a sheet of recording media made of either paper or transparency material, comprising:

feeding said sheet of recording media from a feeding tray;

sending a print command to a video controller;

relaying said print command from said video controller to an engine control unit;

allowing said sheet of recording media to be conveyed past a first sensing unit, said first sensing unit sensing passage of said sheet of recording media;

when said first sensing unit senses passage of said sheet of recording media enabling a second sensing unit, said second sensing unit detecting whether said sheet of recording media is normal paper or is a transparency;

allowing said sheet of recording media to be conveyed past said second sensing unit located adjacent to said feeding tray;

outputting from said second sensing unit to said engine control unit a first signal in response to the passage of a transparency past said second sensing unit;

outputting from said engine control unit to a transfer voltage generator a second signal in response to receipt of said first signal from said second sensing unit;

outputting a first voltage bias by said transfer voltage generator to a transfer charger in response to said second signal received from said engine control unit;

producing a latent image on a photosensitive drum by said engine control unit;

producing a toner image on said photosensitive drum by introducing toner;

conveying said sheet of recording media between said transfer charger and said photosensitive drum, transferring said toner image onto said sheet of recording media;

conveying said sheet of recording media between heated and pressurized rollers to fix said toner image to said sheet of recording media; and discharging said sheet of recording media containing said image from said electrophotographic device.

11. The method of claim 10, where said first voltage applied to said transfer roller is higher than the voltage applied to said transfer roller for printing on paper.

12. The method of claim 11, when said print command is input manually by a user on a keypad from an operation panel connected to said video controller.

13. The method of claim 12, when said print command is input automatically from a host computer connected to said video controller.

14. An electrophotographic device for printing on sheets of recording medium made of either transparency material or paper, comprising:

means for inserting into said device said sheets of recording medium;

means for signaling to a controller of said electrophotographic device that a printing operation is about to be performed;

means for enabling a first sensor that senses passage of said sheets of recording medium;

means for enabling a second sensor in response to said first sensor sensing passage of said sheets of recording medium, said second sensor determining whether said sheets of recording medium are transparencies;

said second sensor for signaling to said controller of said electrophotographic device that said recording medium is a transparency;

means for adjusting a transfer voltage based on said signals received by said controller of said electrophotographic device;

means for transferring an image from a video control unit to a printing engine in said electrophotographic device and then on to said sheets of recording medium;

means for fixing said image onto said sheets of recording medium; and means for discharging said recording medium from said device.

15. The electrophotographic device of claim 14, wherein the magnitude of said transfer voltage is higher when said sheets of recording medium are transparencies than when said sheets of recording medium are paper.

16. The electrophotographic device of claim 15, wherein said means for signaling to said controller of said electrophotographic device that a printing operation is about to be performed is initiated by a manual input from a user via a keypad located on an operation panel connected to said video control unit.

17. The electrophotographic device of claim 16, wherein said means for signaling to said controller of said electrophotographic device that a printing operation is about to be performed is initiated by signals generated from a host computer and connected to said video control unit.

18. A method of automatically controlling transfer voltages of a printer in an electrophotography system having a first recording media sensing means for determining if a sheet of recording media is conveyed to an image forming unit and a second recording media sensing means, comprising the steps of:

enabling said second recording media sensing means upon activation of said first recording media sensing means;

generating said second recording media sensing signal while said sheet of recording media is being conveyed to said image forming unit when said first recording media sensing signal is received from said first recording media sensing means under the control of a central processing unit of the printer; and when an overhead projector (OHP) transparency is being conveyed to the image forming unit, setting a voltage to a level that is preestablished for toner image transfer onto OHP transparency in response to an OHP transparency sensing signal produced by said second recording media sensing means, and when a normal paper is being conveyed to the image forming unit, setting a voltage to a level that is preestablished for toner image transfer onto normal paper for printer performance.

19. The method according to claim 18, said second recording media sensing means comprises:

a light emitting diode producing light under the control of the central processing unit, and a photocoupler consisting of a light receiving transistor which is turned on by the light produced by said light emitting diode if an overhead projector transparency is being conveyed to the image forming unit, and is turned off if normal paper is being conveyed to the image forming unit.

20. A method of automatically achieving optimum image density during an electrophotographic duplication process when various recording medium are used, comprising:

feeding a sheet of recording medium into an electrophotographic machine;

conveying said sheet of recording medium along a conveyance path;

detecting, during the conveyance, said sheet of recording medium;

when said sheet of recording medium is detected, enabling a sensing means that determines whether or not said sheet of recording medium is a sheet of paper or a transparency;

detecting, during said conveyance, whether or not said recording medium is a sheet of paper or is a transparency;

continuing to convey said sheet of recording medium to an image forming means;

applying a transfer voltage bias whose magnitude depends on whether said sheet of recording medium is detected as being a sheet of paper or a transparency;

transferring an image from said image forming means onto said sheet of recording medium; and ejecting said sheet of recording medium from said electrophotographic machine.

* * * * *